United States Patent [19]

Roskilly

[11] Patent Number: 4,821,895

[45] Date of Patent: Apr. 18, 1989

[54] NURSING BOTTLE ACCESSORY HAVING MEANS FOR THE INTRODUCTION OF A SEPARATE SUBSTANCE

[76] Inventor: Stephen Roskilly, 32 Rayden Drive, Borrowdale, Harare, Zimbabwe

[21] Appl. No.: 1,483

[22] Filed: Jan. 8, 1987

[30] Foreign Application Priority Data

Jan. 8, 1986 [ZW] Zimbabwe ..... 3/86

[51] Int. Cl.[4] ..... A61J 9/00

[52] U.S. Cl. ..... 215/11.1; 215/100 R; 215/228; 215/DIG. 8

[58] Field of Search ..... 215/11 R, 11 C, 118, 215/11 D, 100 R, 1 R, 228, DIG. 8, 11.1, 11.4, 11.5, 11.6; 128/359, 360; 604/83, 77, 78; 222/145; D24/46–48

[56] References Cited

U.S. PATENT DOCUMENTS

| | | | |
|---|---|---|---|
| D. 138,925 | 9/1944 | Ostrin et al. | D24/47 |
| 2,680,441 | 6/1954 | Krammer | 215/11 R X |
| 2,931,731 | 4/1960 | Pohjola | 215/11 R X |
| 3,302,644 | 2/1967 | Kennedy et al. | 604/78 |
| 3,426,755 | 2/1969 | Clegg | 604/77 |
| 3,645,262 | 2/1972 | Harrigan | 215/114 R X |
| 3,682,344 | 8/1972 | Lopez | 215/DIG. 8 X |
| 4,581,013 | 4/1986 | Allen | 604/77 X |

FOREIGN PATENT DOCUMENTS

| | | | |
|---|---|---|---|
| 1038319 | 5/1953 | France | 215/11 R |

*Primary Examiner*—Sue A. Weaver

*Attorney, Agent, or Firm*—Cushman, Darby & Cushman

[57] ABSTRACT

The invention relates to a feeding bottle accessory wherein provision is made for the introduction into the bottle teat of material independently of and in addition to the contents of the bottle. The provision preferably includes a syringe assembly.

8 Claims, 3 Drawing Sheets

NURSING BOTTLE ACCESSORY HAVING MEANS FOR THE INTRODUCTION OF A SEPARATE SUBSTANCE

FIELD OF THE INVENTION

This invention relates to a bottle accessory for use in the administration to infants.

BACKGROUND TO THE INVENTION

The administration of medicines to unwilling patients and particularly to infants and young children is a notoriously difficult task.

The problem is that many medicinal preparations are not palatable, in particular for small babies who have not known much else other than milk. Every new taste is an unprecedented and extraordinary experience and even new foods have to be introduced gradually.

One way of introducing new foods is to mix a small amount of a new food with a known food, for example milk. Medicines may also be administered in this way, and are often added to a bottle containing the infant's usual milk feed or some other liquid with which the infant is already familiar.

One problem with administering medicines in this way is that the medicine may become too diluted to remain effective. Another problem is monitoring the dosage of medicine which the infant is receiving, especially where the bottle contents are not consumed in their entirety.

The object of this invention is to provide a bottle accessory for use in the administration of medicines to infants, including young children, which overcomes at least some of the abovementioned problems.

SUMMARY OF THE INVENTION

According to this invention there is provided a feeding bottle accessory comprising a teat holder and bottle closure including a mounting for means for introducing material into the teat separately from the bottle.

Further features of this invention provide for the bottle accessory to have a first end shaped for co-operation with the neck of a bottle and a second end shaped for co-operation with a teat retaining cap, the accessory further having at least two passages, a first passage extending, in use, to communicate between the bottle and the teat, and the second passage extending, in use, to communicate between the teat and the outside of the bottle and providing the mounting.

Further features of the invention provide for the passages to have a common outlet for communicating with the teat; alternatively for each passage to have its own outlet for communicating with the teat.

Still further features of the invention provide for the first end to have a screw-threaded socket and to have a gasket in association with it; for the second end to have a screw-threaded spigot; for the mounting to support a syringe barrel in fixed or removable manner.

Preferably, the accessory according to the invention will be made from injection moulded plastics and will have a syringe barrel integrally formed therein.

BRIEF DESCRIPTION OF THE DRAWINGS

Preferred embodiments of this invention are described below with reference to the accompanying drawings in which.

DETAILED DESCRIPTION WITH REFERENCE TO THE DRAWINGS

Figure 1:
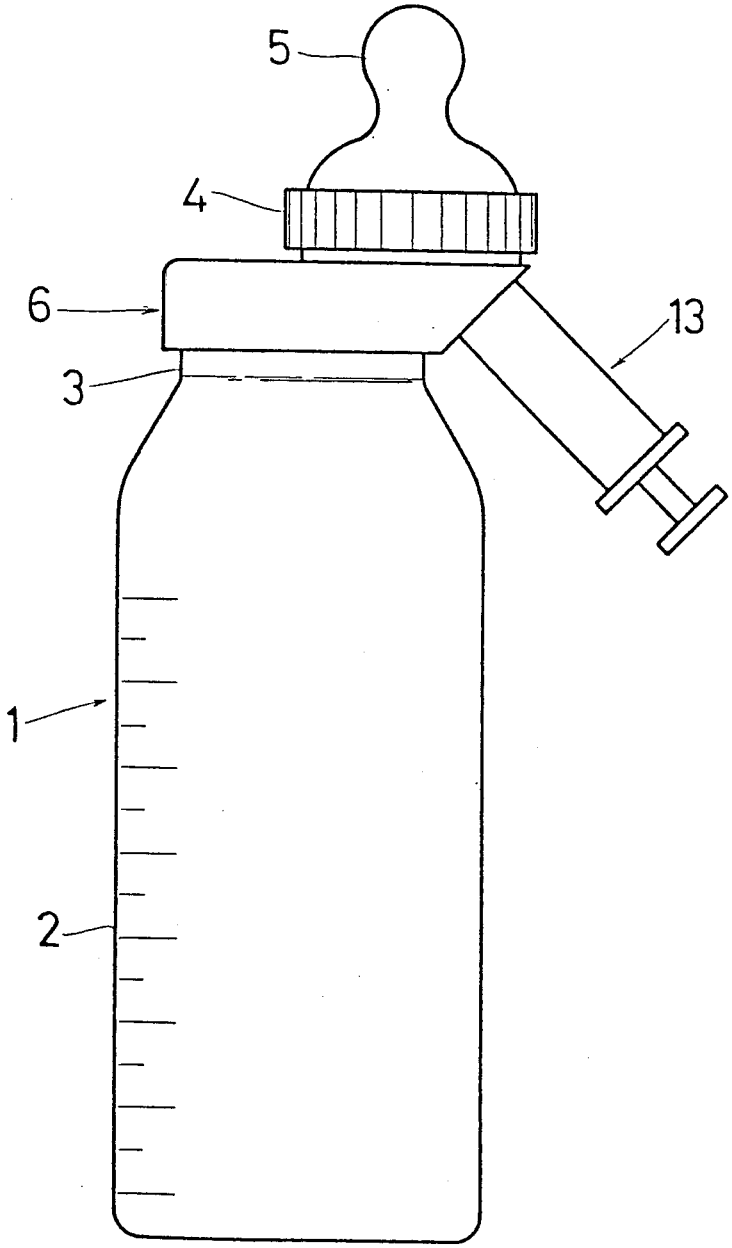
FIG. 1 is an isometric view, illustrating one form of bottle accessory in association with a baby bottle.
Figure 3:
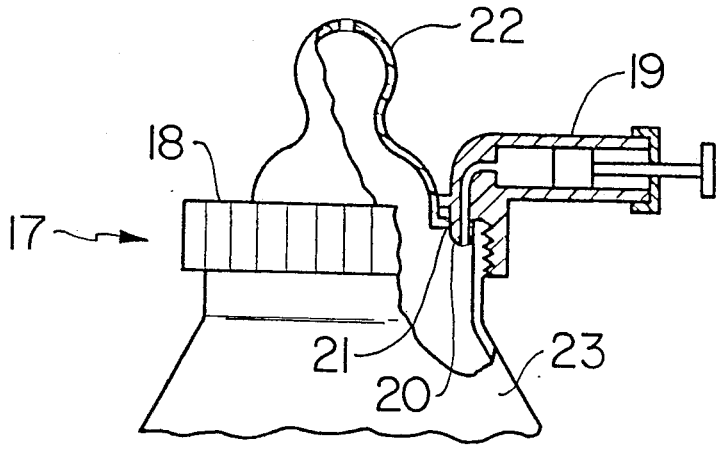
FIG. 3 illustrates an alternative construction of the accessory.

Referring to FIGS. 1 and 3 the bottle assembly generally indicated by numeral 1 includes a standard baby bottle 2 having a screw-threaded neck 3, an annular screw-threaded bottle top 4, and a rubber teat or nipple 5.

The accessory generally indicated by numeral 6 is in use, located between the bottle 2 and annular bottle top 4 and co-operates with them by means of a screw-threaded socket 7 which receives the bottle neck 3 and a spigot 8 which is received in the annular top 4. The accessory 6 also has an annular gasket 9 for sealing it onto the open end of the bottle 2.

Two separate passages 10 and 11 are provided in the accessory 6. The first passage 10 communicates between the bottle 2 and the teat 5. The second passage 11 communicates between the teat 5 and the outside of the bottle 2 and forms a mounting for means for introducing material into the teat separately from the bottle. In the form shown this second passage 11 receives the front end of the barrel 12 of a syringe which is generally indicated by numeral 13 and which is seated in the second passage 11. The barrel 12 may be integrally formed as part of the accessory 6 but can also be conveniently separately manufactured and permanently or releasably fitted to the accessory 6.

The barrel 12 has a nozzle 18 which, in use, is received in a flexible pipe 14 leading to the interior of the teat 5.

A plunger 15 is associated with the barrel 12.

In use, it will be understood that medicine or other material to be given separately from the contents of the bottle is introduced into the syringe 13 and milk or some other suitable liquid in the bottle 2.

Operation of the plunger 15 will deliver the medicine directly into the teat 5 where it will mix with the bottle contents and can be sucked through the teat 5.

It will be appreciated that the administration of medicines with a bottle fitted with an accessory according to the invention will be greatly facilitated. The infant will be more receptive to accepting any medicine administered because it will have been mixed with a liquid with which he will already be familiar. Any dilution of the medicine received in the infant's mouth will be minimal and the administration of the correct dosage can be controlled with an acceptable degree of accuracy, in particular where the syringe barrel 12 is graduated.

Referring to FIG. 3 the bottle closure 17 has formed integrally with the cap 18 the syringe barrel 19. The barrel terminates in a spout 20 which will pass through a perforation in the flange 21 of the teat 22. The perforation will be located within the opening of the bottle 23. The perforation through flange 21 is preferably preformed but the spout 20 could be formed to make the perforation as the closure 17 is completed.

This construction requires that the bottle 23 be screwed into the cap 18 and not the reverse as is usual but this will not cause any great difficulty in the use of this embodiment.

It will be understood that several variations may be made to the above described embodiment of the invention without departing from the scope thereof. In particular, the second passage of the accessory need not receive a syringe and could be adapted to receive any vessel which, in use, will feed into the teat by gravity and by the sucking motion of the baby on the teat.

Figure 2:
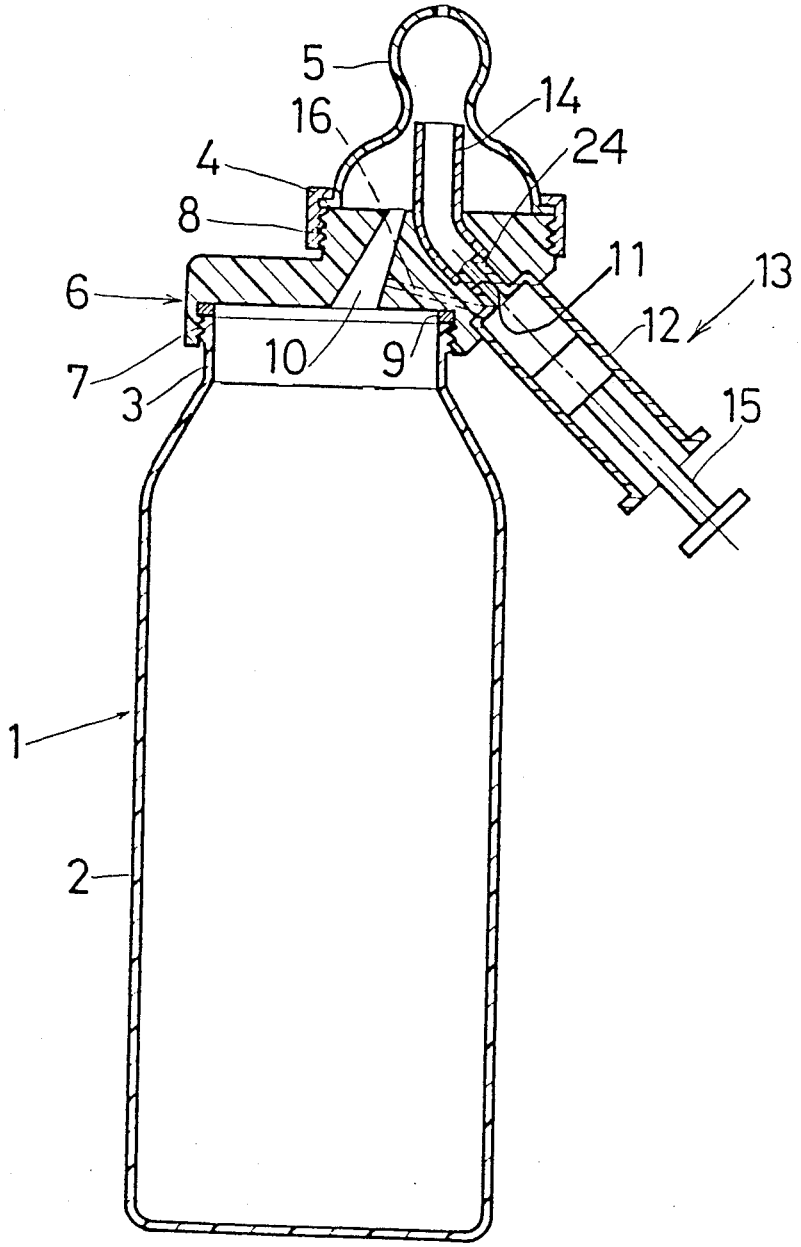
FIG. 2 is a cross-sectional exploded view of the bottle illustrated in FIG. 1.

As previously mentioned, the accessory may also be provided with a single, common outlet for discharging the bottle contents and the medicine into a single stream prior to reaching the teat. The dotted line at 16 in FIG. 2 indicate one way of achieving this.

The invention thus provides a bottle accessory which may advantageously be used in the administration of medicine.

I claim:

1. A feeding bottle accessory comprising a teat holder and bottle closure, said accessory including an exterior mounting structure for receiving means for introducing secondary material into the teat separately from the primary material contained with said bottle, a first end shaped for co-operation with the neck of the bottle and a second end shaped for cooperation with a teat retaining cap, the accessory further having means defining at least two internal passages, a first internal passage providing communication between the bottle and the interior of the teat, and a second internal passage providing communication between the teat and the outside of the bottle through said exterior mounting structure.

2. A feeding bottle accessory as claimed in claim 1 in which each passage in use communicates independently with the teat.

3. A feeding bottle accessory as claimed in claim 2 in which the first end has a gasket in association with it and the second end has a screw-threaded spigot.

4. A feeding bottle accessory as claimed in claim 1 in which the exterior mounting structure is shaped to receive a syringe barrel therein.

5. A feeding bottle accessory as in claim 1 wherein said means for introducing secondary material comprises a syringe barrel integrally formed in a one piece manner with said accessory at said exterior mounting structure.

6. A feeding bottle closure for use with a bottle to administer a secondary substance together with a primary substance contained in the bottle just prior to the discharge of the primary substance from the bottle, said bottle closure comprising means for releasably sealing said bottle closure to the bottle, means for releasably mounting a hollow nipple to said closure, means defining a primary passage within said closure for conducting said primary material from said bottle to the interior of said hollow nipple, means defining a secondary passage within said closure for connecting a first port means defining an exterior port on said closure to a second port means defining an interior port within said closure, and a secondary substance dispenser mounted to said exterior port.

7. A feeding bottle closure as in claim 6 wherein said second port means include a separate flexible conduit having a proximal end connected to said first port means and a distal end extending into the hollow interior of said nipple.

8. A feeding bottle closure as in claim 6 wherein said second port means opens into said primary passage means.

* * * * *